United States Patent [19]

Hidenobu

[11] Patent Number: 4,947,732

[45] Date of Patent: Aug. 14, 1990

[54] ELECTRO-HYDRAULIC SERVO ACTUATOR WITH FUNCTION FOR ADJUSTING RIGIDITY

[75] Inventor: Ako Hidenobu, Ogaki, Japan

[73] Assignee: Teijin Seike Co., Ltd., Osaka, Japan

[21] Appl. No.: 283,309

[22] Filed: Dec. 12, 1988

[30] Foreign Application Priority Data

Mar. 28, 1988 [JP] Japan ..... 63-073831

[51] Int. Cl.[5] ..... F15B 13/16

[52] U.S. Cl. ..... 91/363 R; 92/60; 73/745

[58] Field of Search ..... 91/361, 1, 363 R; 92/60, 60.5, 80, 5 R; 73/745

[56] References Cited

U.S. PATENT DOCUMENTS

| | | | |
|---|---|---|---|
| 3,487,750 | 6/1970 | Borgeson | 91/363 R |
| 4,537,547 | 8/1985 | Cole | 91/361 X |
| 4,700,610 | 10/1987 | Bauer et al. | 91/390 |
| 4,712,570 | 12/1987 | Schmitz | 91/361 X |
| 4,817,498 | 4/1989 | Takagi | 91/361 |

FOREIGN PATENT DOCUMENTS

| | | | |
|---|---|---|---|
| 170901 | 10/1983 | Japan | 91/361 |
| 826102 | 5/1981 | U.S.S.R. | 91/361 |

*Primary Examiner*—Edward K. Look
*Assistant Examiner*—George Kapsalas
*Attorney, Agent, or Firm*—Burgess, Ryan & Wayne

[57] ABSTRACT

An electro-hydraulic servo actuator with function for adjusting rigidity. The electro-hydraulic servo actuator comprises an electro-hydraulic transducer which transduces an electric signal into a hydraulic signal, an actuator of a cylinder type which is operated by the electro-hydraulic transducer, and a position detector which detects a position of an output member of the actuator to emit a positional electric signal. The hydraulic-element transducer is a bias piston which is disposed within a actuator rod of the cylinder type actuator and which floats in response to a differential pressure within the cylinder, and the piston is connected to the position detector. The electro-hydraulic servo actuator further comprises an adder which compares the positional signal from the position detector with a command signal to emit a deviation signal, the deviation signal from the adder being applied to the electro-hydraulic transducer, and a hydraulic-electric transducer which detects hydraulic pressure in the actuator and which applies a signal corresponding to the hydraulic pressure to a portion between the detector and the adder to transduce into an electric signal.

4 Claims, 2 Drawing Sheets

ELECTRO-HYDRAULIC SERVO ACTUATOR WITH FUNCTION FOR ADJUSTING RIGIDITY

BACKGROUND OF THE INVENTION

The present invention relates to an electro-hydraulic servo actuator with function for adjusting rigidity which actuator can be used in an oil hydraulic circuit for hydraulic equipment.

A conventionally used electro-hydraulic servo actuator comprises an electro-hydraulic transducing means which transduces an electric signal into a hydraulic signal, an actuator which is operated by said electro-hydraulic transducing means, a position detector which detects a position of an output member of said actuator to emit a positional electric signal, an adder which compares said positional signal from said position detector with a command signal to emit a deviation signal, and an amplifier which amplifies said deviation signal from said adder and applies it to said electro-hydraulic transducing means.

FIG. 5 shows the relationship between a servo error and output F under a normal condition wherein such a conventional electro-hydraulic servo actuator is steady under an external force $F_0$.

Because of the influence of the external force, there is a difference between a desired value of a servo system and an actual position of an actuator rod, which difference is designated by $\Delta x$. When a gain of the position detector is denoted by $K_2$, the deviation signal e is expressed by the following equation.

$$e=K_2 \cdot \Delta x$$

The actuator outputs a reaction force F which encounters the external force $F_0$, and the forces are balanced with each other so that the actuator becomes steady. Therefore, $$F=F_0$$

Further, providing that the gain of the amplifier is expressed by $K_1$ and that the pressure gain $K_3$ of the valve is linear and is not saturated, the output F is expressed by the following equation. In this equation, symbol A stands for an effective area of the actuator.

$$F=e \cdot K_1 \cdot K_3 \cdot A$$

The ratio of a steady state deviation of a servo actuator, i.e., the difference between a desired value of a servo system and an actual position of an actuator rod, to an external force F will be referred to as rigidity K hereinbelow.

Accordingly, rigidity K is expressed as follows.

$$\begin{aligned} K &= F_0/_x \qquad (1) \\ &= K_1 \cdot K_2 \cdot K_3 \cdot A \end{aligned}$$

When an electro-hydraulic servo actuator is used, for example, as an arm of an industrial robot or to control chucking of parts, to grip relatively soft materials the rigidity K must be lowered so as to prevent the objective materials from being damaged by an excessive load caused by deviation of control.

Contrary to this, the rigidity K must be increased during positioning control in order to decrease the steady state deviation caused by external force.

However, as shown by equation (1) above, in the conventional electro-hydraulic servo actuator, the rigidity K is indiscriminately determined based on the gain $K_1$ of the amplifier, the gain $K_2$ of the position detector, and the pressure gain $K_3$ of the valve.

Accordingly, an electro-hydraulic servo actuator has been desired so that the rigidity can be readily set regardless of the gain $K_1$ of the amplifier, the gain $K_2$ of the position detector, and the pressure gain $K_3$ of the valve.

SUMMARY OBJECT OF THE INVENTION

It is an object of the present invention to provide an electro-hydraulic servo actuator which is provided with function for adjusting rigidity and which is suitable for use in an oil hydraulic circuit for hydraulic equipment.

According to the present invention, the object is achieved by an electro-hydraulic servo actuator with function for adjusting rigidity comprising:

an electro-hydraulic transducing means which transduces an electric signal into a hydraulic signal:

an actuator which is operated by the electro-hydraulic transducing means;

a position detector which detects a position of an output member of the actuator to emit a positional electric signal;

an adder which compares the positional signal from the position detector with a command signal to emit a deviation signal;

the deviation signal from the adder being applied to the electro-hydraulic transducing means; and a hydraulic-electric transducing means which detects hydraulic pressure in the actuator so as to apply a signal corresponding to the hydraulic pressure to a portion between the detector and the adder in order to transduce it into an electric signal.

When an electro-hydraulic servo actuator with function for adjusting rigidity of the present invention is carried out, it is preferred that the actuator is of a cylinder type, the hydraulic-electric transducing means is a bias piston which is disposed within an actuator rod of the cylinder type actuator and which floats in response to a differential pressure within the cylinder, and the piston is connected to the position detector.

According to the present invention, a hydraulic-electric transducing means is disposed so as to detect hydraulic pressure in the actuator and to apply it between the detector and the adder to transduce into an electric signal.

More specifically, providing that the gain between the differential pressure in the actuator and the sliding amount of the piston is expressed by $K_4$, a block diagram in a steady state is shown in FIG. 3.

The block diagram illustrated in FIG. 3 is equivalent to that illustrated in FIG. 4.

Accordingly, the rigidity of the actuator of the present invention is expressed by the following equation.

$$K=K_1 \cdot K_2 \cdot K_3 \cdot A/(1+K_1 \cdot K_2 \cdot K_3 \cdot K_4) \qquad (2).$$

When the equations (1) and (2) are compared with each other, it will be readily noted that the rigidity of the present invention is $1/(1+K_1 \cdot K_2 \cdot K_3 \cdot K_4)$ times as large as that of the above-described conventional actuator.

If the gain $K_4$ is positive, the rigidity is lowered. When the bias is negative, the rigidity will be increased.

BRIEF DESCRIPTION OF THE DRAWINGS

Some embodiments of the present invention will now be explained in detail with reference to the accompanying drawings, wherein.

DESCRIPTION OF THE PREFERRED EMBODIMENTS

Figure 1:
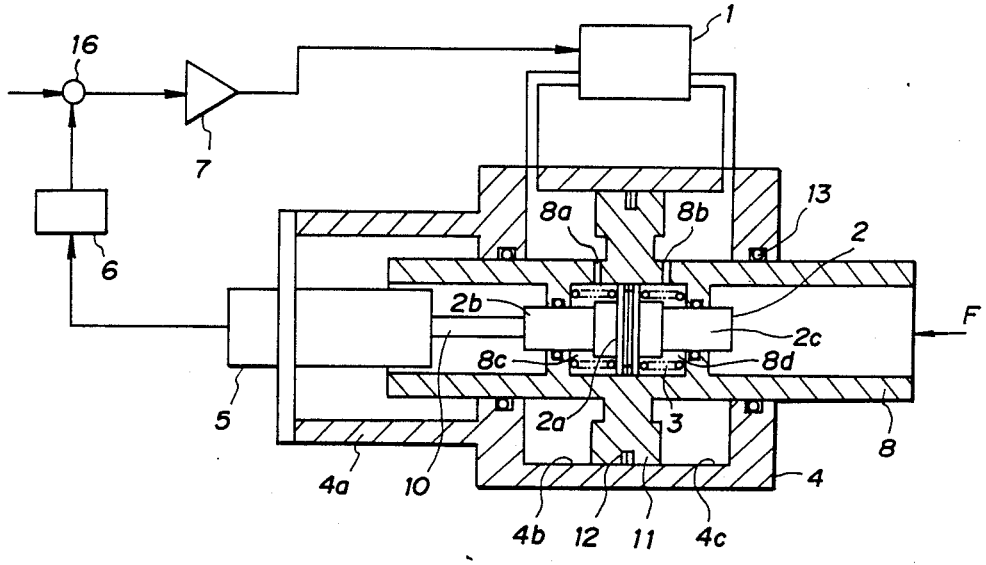
FIG. 1 is a cross sectional view of a first embodiment of the present invention.

In FIG. 1, which is a cross sectional view of a first embodiment of the present invention, an electro-hydraulic transducing means 1, which transduces an electric signal into a hydraulic signal, is communicated with cylinder chambers 4*b* and 4*c* of a cylinder type actuator 4. A piston 11 of an actuator rod 8 is slidably and sealingly inserted into the cylinder chambers 4*b* and 4*c*.

Pressures of working fluid are applied to both the sides of the piston 11 of the actuator 8. Reference numerals 12 and 13 denote seals.

The actuator rod 8 further has bias cylinder chambers 8*c* and 8*d* formed therein, which communicate with the cylinder chambers 4*b* and 4*c* through small apertures 8*a* and 8*b*, respectively. A bias piston 2 is slidably and sealingly inserted in the bias cylinder chambers 8*c* and 8*d* formed in the actuator rod 8, and the bias piston 2 has a piston portion 2*a* and rod portion 2*b* and 2*c* projecting from the piston portion 2*a*.

Springs 3 bear on both the sides of the piston portion 2*a* so as to locate the bias piston 2 at a neutral position under a normal condition.

The rod portion 2*b* is connected to an LVDT, i.e., a linear variable-difference transformer 5, which serves as a position detector, via a connecting rod 10.

The linear variable-difference transformer 5 is communicated with a demodulator 6, which is communicated with an adder 16.

The adder 16 receives a servo command signal and emits an output signal corresponding to a deviation between said servo command signal and the signal from the demodulator 6, and the adder 16 inputs it to an amplifier 7.

The amplifier 7 amplifies the deviation so as to input it to the electro-hydraulic transducing means 1.

According to the above-described construction, receiving a bias command signal, a signal amplified by the amplifier 7 is input to the electro-hydraulic transducing means 1 so as to operate the actuator rod 8.

As described above, the actuator rod 8 accommodates the bias piston 2, and the actuator rod 8 has small apertures 8*a* and 8*b* so that the differential pressure between the actuator cylinder chambers 4*b* and 4*c* is led to the actuator rod 8.

The bias piston 2 is backed up by the springs 3 and is capable of sliding in accordance with the differential pressure.

As described above, the front end of the core of the LVDT, i.e., the linear variable-difference transformer 5, which serves as a position detector, is connected to the bias piston 2. As a result, a positional signal input to the LVDT, i.e., the linear variable-difference transformer 5, corresponds to, not the position of the actual actuator rod 8, but the value which is obtained by reducing the bias, i.e., the displacement of the bias piston 2 due to the differential pressure, from the position of the actual actuator rod 8.

According to the embodiment illustrated in FIG. 1, the rigidity of the electro-hydraulic servo actuator can be lowered. Accordingly, this embodiment is preferred when a large steady state deviation is required for a servo actuator in response to an external force. Therefore, an excessive load can be prevented from occurring by deviation of control, when an electro-hydraulic servo actuator of this type is used, for example, as an arm of an industrial robot or to control chucking of parts, to grip relatively soft materials.

Further, generally speaking, when a plurality of servo actuators are used to drive one single controlled system, a force fight may be caused between the actuators due to the deviation of control, and accordingly, the controlled system may be subjected to unfavorable stress. According to the first embodiment, such force fight as described above can be avoided or can be reduced.

Figure 2:
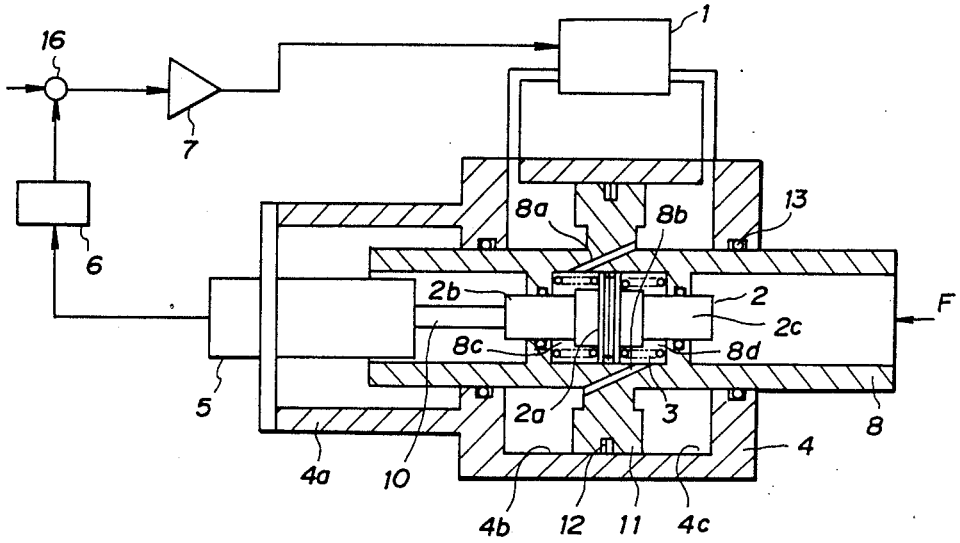
FIG. 2 is a cross sectional view of a second embodiment of the present invention.
Figure 3:
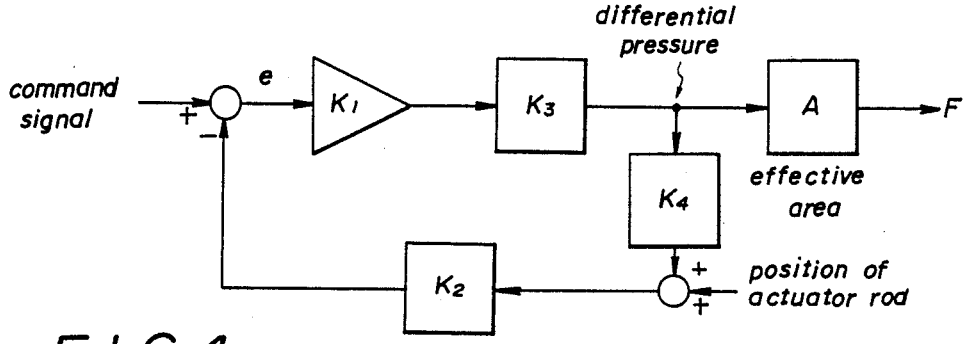
FIG. 3 is a block diagram of the present invention.
Figure 4:
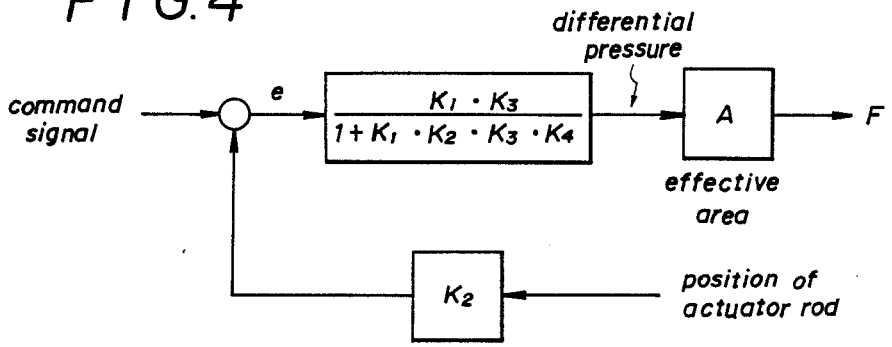
FIG. 4 is a block diagram which is equivalent to that illustrated in FIG. 3.
Figure 5:
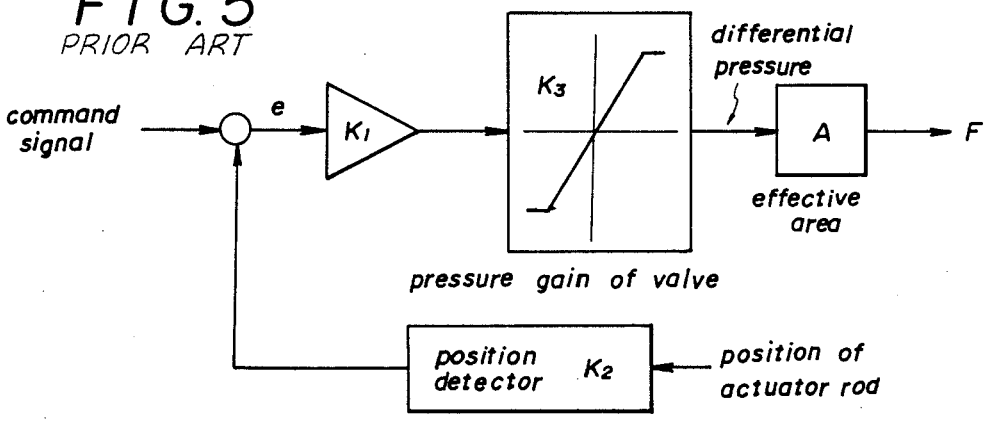
FIG. 5 PRIOR ART
FIG. 5 is a diagram showing a conventional servo actuator.

Another embodiment is illustrated in FIG. 2. In this embodiment, the cylinder chambers 4*b* and 4*c* and the bias cylinder chambers 8*c* and 8*d* formed in the actuator rod 8 are communicated with each other through small apertures 8*a* and 8*b*, respectively, which apertures intersect each other.

Accordingly, contrary to the embodiment illustrated in FIG. 1, the sum of the position signal of the actual actuator rod 8 and the bias, i.e., the displacement of the bias piston 2, due to the differential pressure is added to the LVDT, i.e., linear variable-difference transformer 5.

According to the embodiment illustrated in FIG. 2, the rigidity of the electro-hydraulic servo actuator can be increased. Accordingly, this embodiment is suitable for decreasing a steady state deviation caused by an external force during positioning control.

This embodiment can be used, for example, to obviate a problem of a steady state deviation caused by an external force which problem is caused by an excessively low pressure gain of an electro-hydraulic valve used in a servo loop.

What we claim is:

1. An electro-hydraulic servo actuator with function for adjusting rigidity comprising:

an electro-hydraulic transducing means which transduces an electric signal into a hydraulic signal;

an actuator which is operated by said electro-hydraulic transducing means;

a position detector which detects a position of an output member of said actuator to emit a positional electric signal;

an adder which compares said positional signal from said position detector with a command signal to emit a deviation signal;

said deviation signal from said adder being applied to said electro-hydraulic transducing means; and a hydraulic-electric transducing means which detects hydraulic pressure in said actuator so as to apply a signal corresponding to said hydraulic pressure to a position between said detector and said adder in order to transduce it into an electric signal;

said actuator being of a cylinder type; and said hydraulic-electric transducing means being a bias piston which is disposed within an actuator rod of said cylinder type actuator and which floats in response to a differential pressure within said cylinder, and said piston being connected to said position detector.

2. An electro-hydraulic servo actuator with function for adjusting rigidity according to claim 1, wherein said position detector is a linear variable-difference transformer.

3. An electro-hydraulic servo actuator with function for adjusting rigidity comprising:

an electro-hydraulic transducing means which transduces an electric signal into a hydraulic signal;

an actuator of a cylinder type which is operated by said electro-hydraulic transducing means;

a position detector which detects a position of an output member of said actuator to emit a positional electric signal;

an adder which compares said positional signal from said position detector with a command signal to emit a deviation signal;

said deviation signal from said adder being applied to said electro-hydraulic transducing means; and a hydraulic-electric transducing means which is a bias piston disposed within an actuator rod of said cylinder type actuator and which floats in response to a differential pressure within said cylinder, and said piston is connected to said position detector.

4. An electro-hydraulic servo actuator with function for adjusting rigidity according to claim 3, wherein said position detector is a linear variable-difference transformer.

* * * * *